US011964799B2

(12) United States Patent
Wommelsdorf et al.

(10) Patent No.: US 11,964,799 B2
(45) Date of Patent: Apr. 23, 2024

(54) CLOSURE OF AN OUTLET FITTING

(71) Applicant: GEORG MENSHEN GMBH & CO. KG, Finnentrop (DE)

(72) Inventors: Jan Wommelsdorf, Kirchhundem (DE); Volker Koelsche, Schalksmuehle (DE); Tim Gierse, Attendorn (DE); Frank Roemer, Finnentrop (DE)

(73) Assignee: GEORG MENSHEN GMBH & CO. KG, Finnentrop (DE)

( * ) Notice: Subject to any disclaimer, the term of this patent is extended or adjusted under 35 U.S.C. 154(b) by 340 days.

(21) Appl. No.: 17/603,004

(22) PCT Filed: Mar. 16, 2020

(86) PCT No.: PCT/EP2020/057037
§ 371 (c)(1),
(2) Date: Oct. 12, 2021

(87) PCT Pub. No.: WO2020/212037
PCT Pub. Date: Oct. 22, 2020

(65) Prior Publication Data

US 2022/0119163 A1 Apr. 21, 2022

(30) Foreign Application Priority Data

Apr. 15, 2019 (DE) ..... 10 2019 002 719.1

(51) Int. Cl.
*B65D 41/04* (2006.01)
*B65D 55/16* (2006.01)
*B65D 75/58* (2006.01)

(52) U.S. Cl.
CPC ..... *B65D 41/0485* (2013.01); *B65D 55/16* (2013.01); *B65D 75/5883* (2013.01); *B65D 2401/30* (2020.05)

(58) Field of Classification Search
CPC B65D 75/5883; B65D 41/0485; B65D 55/16; B65D 2401/30
See application file for complete search history.

(56) References Cited

U.S. PATENT DOCUMENTS 175,759 A 4/1876 Rich et al.
2,155,329 A 4/1939 Perdue
(Continued)

FOREIGN PATENT DOCUMENTS

CN 1830730 A 9/2006
CN 1832889 A 9/2006
(Continued)

*Primary Examiner* — James N Smalley
(74) *Attorney, Agent, or Firm* — Norman B. Thot

(57) ABSTRACT

A plastic closure of an outlet fitting of a container includes a closure cap which is releasably attached to the outlet fitting, and a retaining strip which permanently connects the closure cap with the outlet fitting. The retaining strip includes a first and a second bottom end, an upper part, a first and a second strip section, and at least one tearable web. The retaining strip is connected with the closure cap via the at least one tearable web between the first bottom end and the second bottom end, and/or, the first strip section and the second strip section are connected with one another via the at least one tearable web, and/or, the retaining strip is connected with the closure cap or with a cap gripping area of the closure cap via the at least one tearable web.

23 Claims, 4 Drawing Sheets

(56) References Cited

U.S. PATENT DOCUMENTS

| | | | | |
|---|---|---|---|---|
| 4,564,114 | A * | 1/1986 | Cole | B65D 55/16 215/256 |
| 5,725,115 | A | 3/1998 | Bösl et al. | |
| 6,138,849 | A | 10/2000 | Roemer et al. | |
| 7,591,398 | B2 | 9/2009 | Pritikin et al. | |
| 2004/0016715 | A1 | 1/2004 | Strikovic | |
| 2004/0238564 | A1 | 12/2004 | Bourque et al. | |
| 2008/0197135 | A1* | 8/2008 | Berman | B65D 41/34 215/276 |
| 2010/0005641 | A1 | 1/2010 | Druitt et al. | |
| 2014/0103005 | A1 | 4/2014 | Cerveny | |
| 2023/0365318 | A1* | 11/2023 | Zammori | B65D 47/06 |
| 2023/0373689 | A1* | 11/2023 | Buzzi | B65D 75/5883 |

FOREIGN PATENT DOCUMENTS

| | | | |
|---|---|---|---|
| CN | 103596851 | A | 2/2014 |
| EP | 0 810 952 | B1 | 11/1998 |
| EP | 1 953 093 | A1 | 8/2008 |
| EP | 1 940 693 | B1 | 1/2012 |
| JP | 2006-335416 | A | 12/2006 |
| WO | WO 98/45190 | A1 | 10/1998 |
| WO | WO 99/65791 | A1 | 12/1999 |
| WO | WO 2004/108554 | A1 | 12/2004 |

* cited by examiner

CLOSURE OF AN OUTLET FITTING

CROSS REFERENCE TO PRIOR APPLICATIONS

This application is a U.S. National Phase application under 35 U.S.C. § 371 of International Application No. PCT/EP2020/057037, filed on Mar. 16, 2020 and which claims benefit to German Patent Application No. 10 2019 002 719.1, filed on Apr. 15, 2019. The International Application was published in German on Oct. 22, 2020 as WO 2020/212037 A1 under PCT Article 21 (2).

FIELD

The present invention relates to a plastic closure of a tubular outlet fitting of a container having a closure cap that is releasably attached to the fitting, in particular via a thread, the cap being permanently connected with the fitting via a retaining strip.

BACKGROUND

EP 0 810 952 B1 describes that a closure cap can be attached to a threaded fitting of a container via a retaining strip in order to keep the cap inseparable from the container even when the cap has been unscrewed and the liquid can be removed from the container. It is thereby provided that the unscrewed cap is not detached from the container and that the environment is not polluted. However, the short retaining strip only allows for a limited angle of rotation for unscrewing the cap.

SUMMARY

An aspect of the present invention is to improve a closure of the type referenced above so that, with a simple design and handling, a secure retention of the unscrewed cap at the container is provided when the thread between the cap and the outlet fitting has a larger angle of rotation.

In an embodiment, the present invention provides a plastic closure of a tubular outlet fitting of a container. The plastic closure includes a closure cap which is configured to be releasably attached to the tubular outlet fitting, and at least one retaining strip via which the closure cap is permanently connected with the tubular outlet fitting. The closure cap comprises at least one cap gripping area. The at least one retaining strip comprises a first bottom end, a second bottom end, an upper part, a first strip section, a second strip section, and at least one tearable web. When a fitting axis of the closure cap is in a vertical position, the first bottom end of the at least one retaining strip is attached to the tubular outlet fitting, from where the first strip section runs upwards along a side of the closure cap. When the closure cap is in a closed position, the upper part of the at least one retaining strip further comprises a bent over section from where the second strip section runs downwards to the second bottom end which is attached to the closure cap. The at least one retaining strip is connected with the closure cap via the at least one tearable web between the first bottom end and the second bottom end, and/or, the first strip section and the second strip section are connected with one another via the at least one tearable web, and/or, the at least one retaining strip is connected with the closure cap or with the at least one cap gripping area of the closure cap via the at least one tearable web.

BRIEF DESCRIPTION OF THE DRAWINGS

The present invention is described in greater detail below on the basis of embodiments and of the drawings in which.

DETAILED DESCRIPTION

Figure 1:
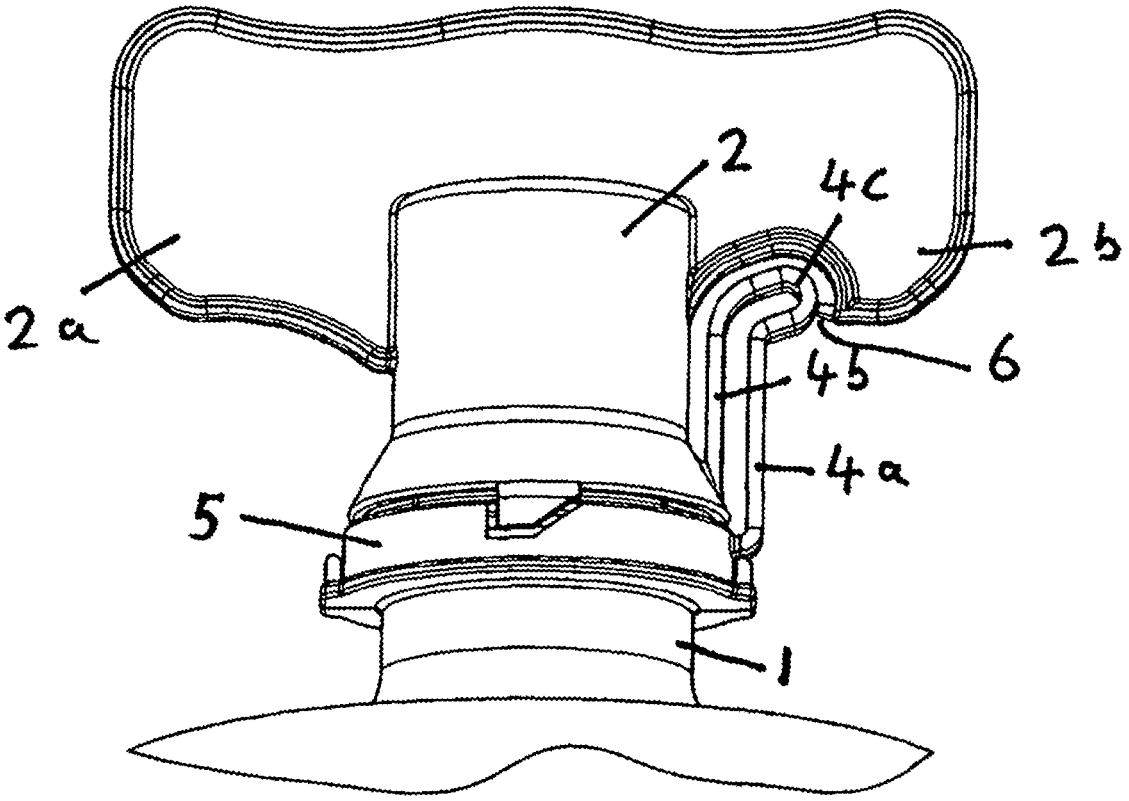
FIG. 1 shows a first embodiment of the present invention with a screwed-on cap with gripping wings and one retaining strip.

The present invention provides that, with a fitting axis in its vertical position, the retaining strip is attached to the fitting with a first bottom end from where a first strip section runs upwards along the side of the cap and, with the screwed-on cap, the retaining strip exhibits a bent-over section in its upper part from where a second strip section runs downwards again to its second bottom end which is fixed to the cap.

Such a design results in a retaining strip having a greater length so that the thread can have a large angle of rotation for unscrewing the cap. Production, design and handling are particularly simple with this construction.

The two sections of the retaining strip can, for example, run parallel to one another over a large portion of their lengths. It is also advantageous if the two strip sections run parallel to the fitting axis over a part of their lengths.

An unscrewing angle of any desired size can be achieved if the first end of the strip retainer that is connected with the fitting is fixed to a ring that is coaxial to the fitting axis and is rotatably carried on the fitting so that the ring rotates with the cap.

An initial opening of the closure is displayed:

- When the retaining strip is connected with the cap by at least one tearable web between its ends;
- When the two strip sections are connected with one another by at least one tearable web;
- When the strip is connected with the cap or a cap gripping area via a tearable web.

The cap is particularly securely held at the container if, on both sides of the cap, one retaining strip each is arranged diametrically opposite to the other.

A small opening rotation of the cap is required if the cap is attached to the fitting via a bayonet catch and if the thread between cap and fitting is so steep that the cap is already unscrewed from the fitting after a rotation of the cap by 90° to 180°.

The cap is easy to grip if the cap has laterally projecting, wing-shaped gripping areas at its upper end.

With the cap screwed-on in the closed position, the retaining strip is in a protected position and the retaining strip clings with its upper bend-over portion to the bottom side of the wing-shaped gripping area. A protected and visually appealing position of the retaining strip is achieved if the retaining strip clings to the outer contour of the cap. It is also proposed in this respect that one strip section or both strip sections lie(s) in a recess or groove opening to the outside of the cap.

For pouch packages, a boat-shaped welding part can, for example, be molded at the bottom end of the fitting.

Embodiments of the present invention are shown in the drawings and are described in greater detail below.

A plastic container for liquids has at its top a vertically upward projecting tubular outlet fitting 1 with a male thread 3. A cap 2 is screwed with its female thread onto the outlet fitting and closes the upper opening of the outlet fitting 1. At the upper end of the cap 2, two wing-shaped gripping areas 2*a*, 2*b* are molded which project from the cap 2 on diametrically opposed positions.

Figure 2:
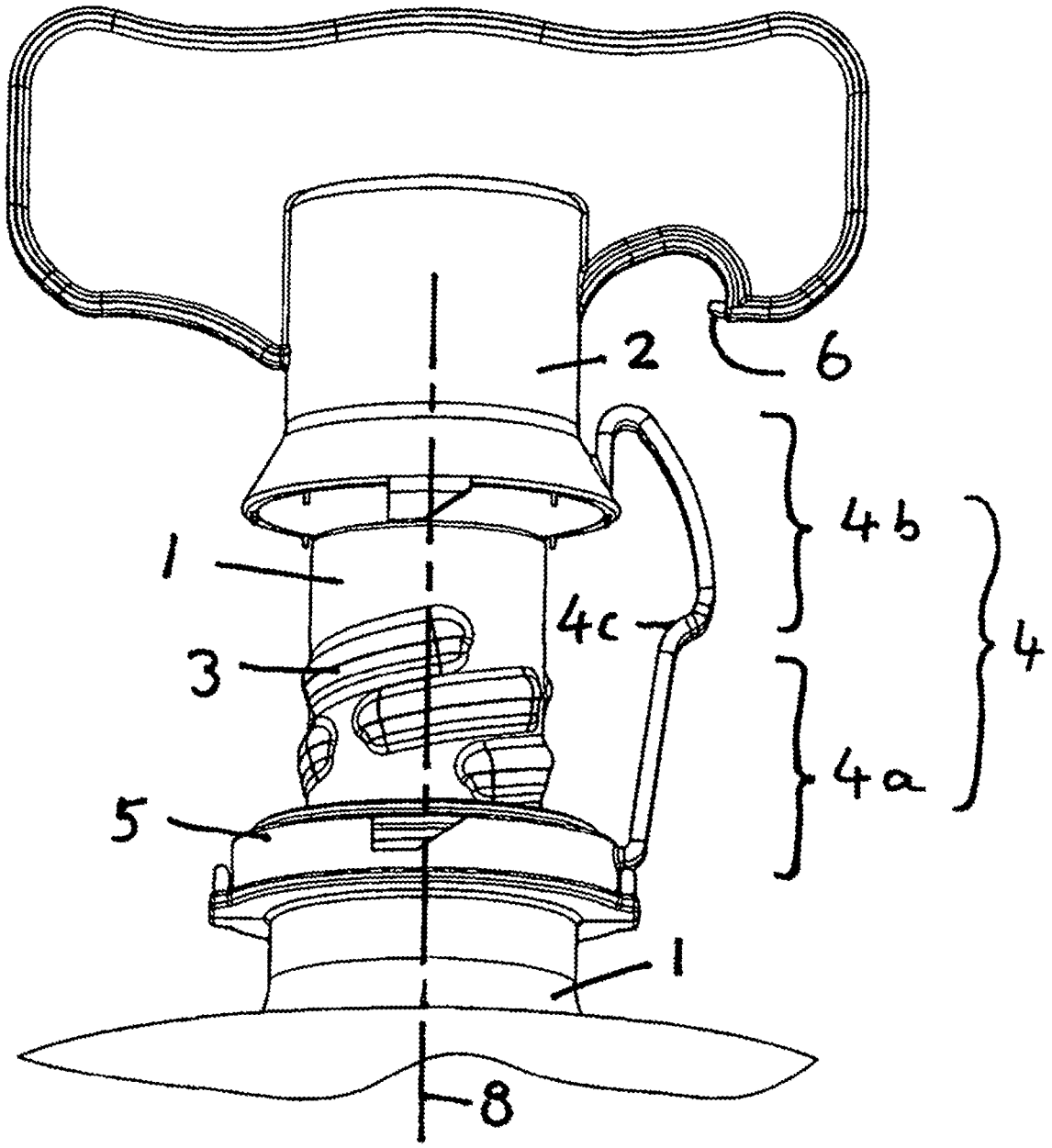
FIG. 2 shows the first embodiment of the present invention with an unscrewed cap with gripping wings and one retaining strip.

In the embodiment according to FIGS. 1 and 2, the cap 2 is connected with the outlet fitting 1 by one retaining strip 4. For this purpose, the retaining strip 4 has two strip sections 4*a*, 4*b* lying on top of one another in a parallel arrangement, the bottom end of the first strip section 4*a* being attached to the outlet fitting 1, in particular to a ring 5 which is coaxial to the fitting axis 8 and which is rotatably carried by the outlet fitting 4. At the upper end of the first strip section 4*a*, via a bent-over portion 4*c*, the second strip section 4*b* is attached or molded, the bottom end of which is fixed to the cap 2 as is shown in FIG. 1 with the screwed-on cap and closed closure.

With the cap 2 screwed on (FIG. 1), the two strip sections 4*a*, 4*b* form a vertically upwards rising loop with two strip sections 4*a*, 4*b* running parallel to one another over most of their lengths and also running parallel to the fitting axis 8. In a closed condition, the retaining strip 4 with its upper bent-over portion 4*c* clings to the bottom side of the wing-shaped gripping area 2*a*, 2*b*, the gripping area 2*b* having at its bottom side a recess into which the upper bent-over portion 4*c* protrudes. The restraining strip 4 thereby clings to the outside of the cap 2. In an embodiment that is not shown, the second strip section 4*b* or both strip sections 4*a*, 4*b* of the retaining strip 4 lie(s) in a recess or groove opening to the outside of the cap 2 so that the retaining strip 4 is protected against damage.

In order to detect if the closure as already been opened, the closure is provided with a tamper-evident security feature. To this effect, either:

The retaining strip 4 is connected with the cap 2 by at least one tearable web 6 between its ends; or The retaining strip 4 is connected with the cap 2 or one cap gripping area 2*b* by a tearable web 6; or The two strip sections 4*a*, 4*b* are connected with one another by at least one tearable web 7.

Figure 3:
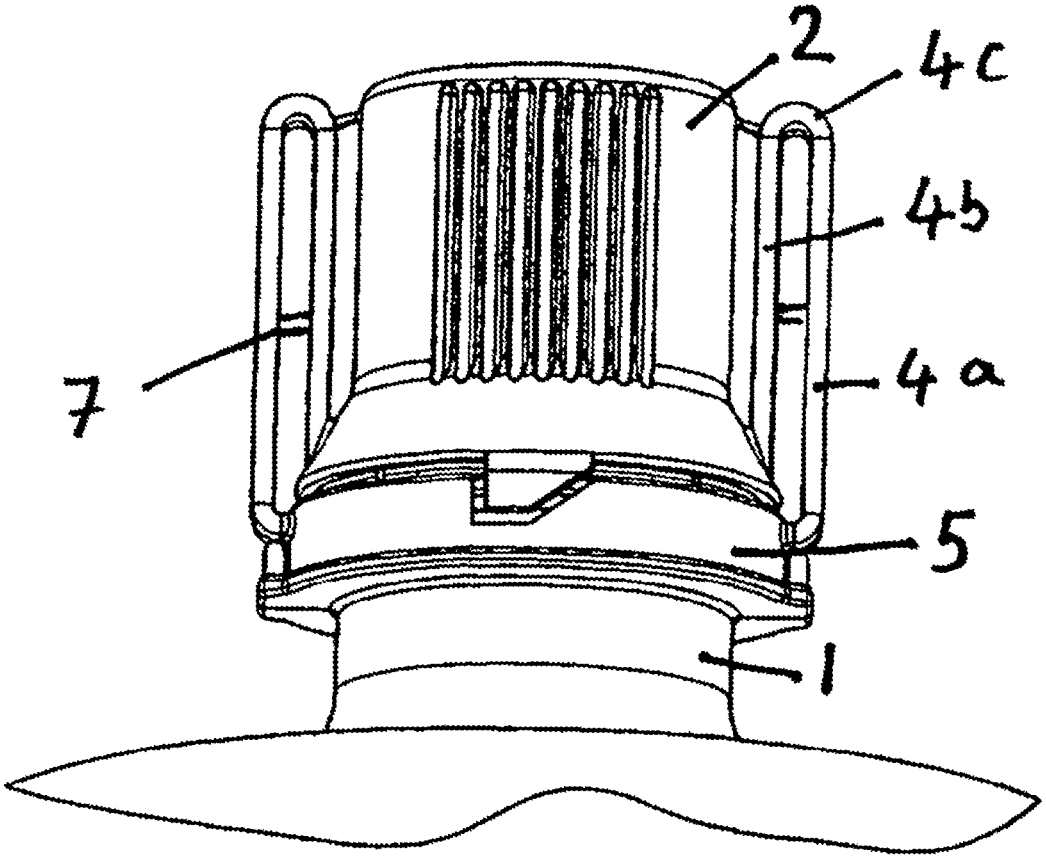
FIG. 3 shows a second embodiment of the present invention with a screwed-on closed cap without gripping wings and with two retaining strips.
Figure 4:
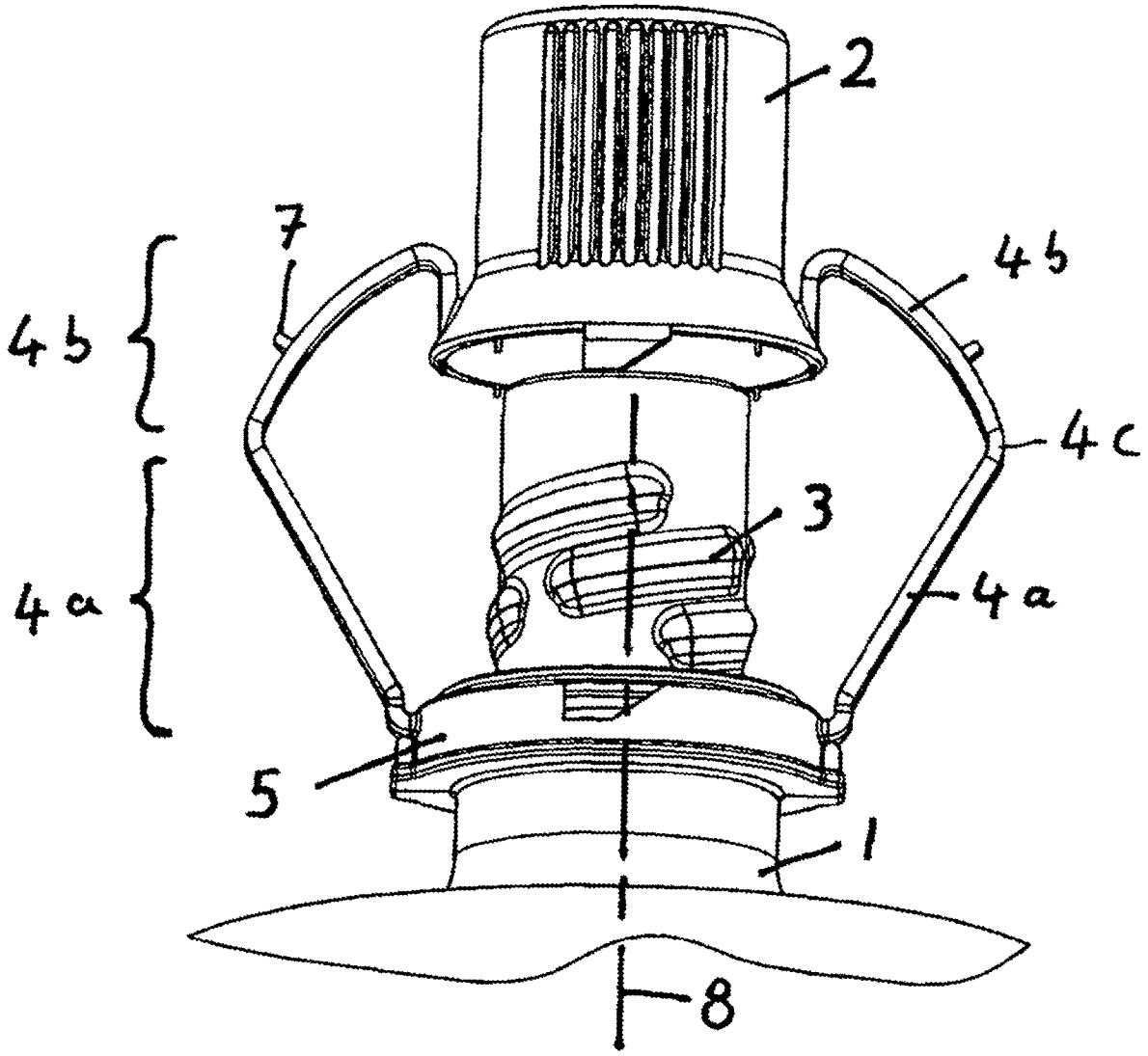
FIG. 4 shows the second embodiment of the present invention with an unscrewed cap without gripping wings and with two retaining strips.

The embodiment shown in FIGS. 3 and 4 differs from the embodiment shown in FIGS. 1 and 2 in that, on two diametrically opposed sides of the outlet fitting 1 and the cap 2, one vertically arranged retaining strip 4 each is attached with two strip sections 4*a*, 4*b* lying on top of one another. The cap 2 is thereby connected even more effectively with the outlet fitting 1 so as to be inseparable therefrom. The cap also does not exhibit any projecting gripping areas in this embodiment.

In further embodiments which are not shown, the cap 2 is not connected with the outlet fitting 1 via a thread, but via a bayonet catch. For pouch packages, a boat-like welding part may also be molded to the bottom end of the outlet fitting 1.

The present invention is not limited to embodiments described herein; reference should be had to the appended claims.

LIST OF REFERENCE NUMERALS

1 Outlet fitting
2 Cap
2*a* Wing-shaped gripping area
2*b* Wing-shaped gripping area
3 Male thread
4 Retaining strip
4*a* First strip section
4*b* Second strip section
4*c* Upper bent-over portion
5 Ring
6 Tearable web
7 Tearable web
8 Fitting axis

What is claimed is:

1. A plastic closure of a tubular outlet fitting of a container, the plastic closure comprising:

a closure cap which is configured to be releasably attached to the tubular outlet fitting, the closure cap comprising at least one cap gripping area; and at least one retaining strip via which the closure cap is permanently connected with the tubular outlet fitting, the at least one retaining strip comprising, a first bottom end, a second bottom end, an upper part, a first strip section, a second strip section, and at least one tearable web, wherein, when a fitting axis of the closure cap is in a vertical position, the first bottom end of the at least one retaining strip is attached to the tubular outlet fitting, from where the first strip section runs upwards along a side of the closure cap, when the closure cap is in a closed position, the upper part of the at least one retaining strip further comprises a bent over section from where the second strip section runs downwards to the second bottom end which is attached to the closure cap, and at least one of, the at least one retaining strip is connected with the closure cap via the at least one tearable web between the first bottom end and the second bottom end or the at least one retaining strip is connected with the at least one cap gripping area of the closure cap via the at least one tearable web, and the first strip section and the second strip section are connected with one another via the at least one tearable web, wherein, when the closure cap is in the closed position, the closure cap further comprises a recess or a groove opening in an outside of the closure cap, and only the second strip section or both the first strip section and the second strip section lie in the recess or in the groove opening.

2. The plastic closure as recited in claim 1, wherein, the closure cap further comprises a thread, and the closure cap is releasably attached to the tubular outlet fitting via the thread.

3. The plastic closure as recited in claim 2, wherein the thread between the closure cap and the tubular outlet fitting is configured so that the closure cap is completely unscrewed from the tubular outlet fitting after a rotation of the closure cap relative to the tubular outlet fitting of 90° to 180°.

4. The plastic closure as recited in claim 1, wherein, when the closure cap is in the closed position, the first strip section and the second strip section run parallel to one another over a part of their respective lengths.

5. The plastic closure as recited in claim 1, wherein the first strip section and the second strip section run parallel to the fitting axis over a part of their respective lengths.

6. The plastic closure as recited in claim 1, wherein, the tubular outlet fitting comprises a ring that is coaxial to the fitting axis and which is rotatably carried by the tubular outlet fitting, and the first bottom end of the at least one retaining strip is attached to the ring.

7. The plastic closure as recited in claim 1, wherein, the at least one retaining strip comprises a first retaining strip and a second retaining strip, and the first retaining strip and the second retaining strip are arranged on diametrically opposed positions of the closure cap.

8. The plastic closure as recited in claim 1, wherein the closure cap is further attached to the tubular outlet fitting via a bayonet catch.

9. The plastic closure as recited in claim 1, wherein, the at least one cap gripping area comprises a first cap gripping area and a second cap gripping area, and each of the first cap gripping area and the second cap gripping area are provided as a wing-shaped laterally projecting gripping area at their respective upper ends.

10. The plastic closure as recited in claim 9, wherein, when the closure cap is in the closed position, the bent-over section in the upper part of the retaining strip nestles in a bottom side of one wing-shaped laterally projecting gripping area.

11. The plastic closure as recited in claim 1, wherein the at least one retaining strip nestles in an outer contour of the cap.

12. The plastic closure as recited in claim 1, wherein, for a pouch package, the tubular outlet fitting further comprises a welding part molded at the bottom end thereof.

13. A plastic closure of a tubular outlet fitting of a container, the plastic closure comprising:

a closure cap which is configured to be releasably attached to the tubular outlet fitting, the closure cap comprising at least one cap gripping area which comprises a first cap gripping area and a second cap gripping area, each of the first cap gripping area and the second cap gripping area being provided as a wing-shaped laterally projecting gripping area at their respective upper ends; and at least one retaining strip via which the closure cap is permanently connected with the tubular outlet fitting, the at least one retaining strip comprising, a first bottom end, a second bottom end, an upper part, a first strip section, a second strip section, and at least one tearable web, wherein, when a fitting axis of the closure cap is in a vertical position, the first bottom end of the at least one retaining strip is attached to the tubular outlet fitting, from where the first strip section runs upwards along a side of the closure cap, when the closure cap is in a closed position, the upper part of the at least one retaining strip further comprises a bent over section from where the second strip section runs downwards to the second bottom end which is attached to the closure cap, when the closure cap is in the closed position, the bent-over section in the upper part of the retaining strip nestles in a bottom side of one wing-shaped laterally projecting gripping area, and at least one of, the at least one retaining strip is connected with the closure cap via the at least one tearable web between the first bottom end and the second bottom end or the at least one retaining strip is connected with the at least one cap gripping area of the closure cap via the at least one tearable web, and the first strip section and the second strip section are connected with one another via the at least one tearable web.

14. The plastic closure as recited in claim 13, wherein, when the closure cap is in the closed position, the closure cap further comprises a recess or a groove opening in an outside of the closure cap, and only the second strip section or both the first strip section and the second strip section lie in the recess or in the groove opening.

15. The plastic closure as recited in claim 13, wherein, the closure cap further comprises a thread, and the closure cap is releasably attached to the tubular outlet fitting via the thread.

16. The plastic closure as recited in claim 15, wherein the thread between the closure cap and the tubular outlet fitting is configured so that the closure cap is completely unscrewed from the tubular outlet fitting after a rotation of the closure cap relative to the tubular outlet fitting of 90° to 180°.

17. The plastic closure as recited in claim 13, wherein, when the closure cap is in the closed position, the first strip section and the second strip section run parallel to one another over a part of their respective lengths.

18. The plastic closure as recited in claim 13, wherein the first strip section and the second strip section run parallel to the fitting axis over a part of their respective lengths.

19. The plastic closure as recited in claim 13, wherein, the tubular outlet fitting comprises a ring that is coaxial to the fitting axis and which is rotatably carried by the tubular outlet fitting, and the first bottom end of the at least one retaining strip is attached to the ring.

20. The plastic closure as recited in claim 13, wherein, the at least one retaining strip comprises a first retaining strip and a second retaining strip, and the first retaining strip and the second retaining strip are arranged on diametrically opposed positions of the closure cap.

21. The plastic closure as recited in claim 13, wherein the closure cap is further attached to the tubular outlet fitting via a bayonet catch.

22. The plastic closure as recited in claim 13, wherein the at least one retaining strip nestles in an outer contour of the cap.

23. The plastic closure as recited in claim 13, wherein, for a pouch package, the tubular outlet fitting further comprises a welding part molded at the bottom end thereof.

* * * * *